US005211302A

United States Patent [19]

Tiramani

[11] Patent Number: 5,211,302

[45] Date of Patent: May 18, 1993

[54] COSMETIC ORGANIZER

[76] Inventor: Paolo Tiramani, 461 Taconic Rd., Greenwich, Conn. 06831

[21] Appl. No.: 913,803

[22] Filed: Jul. 16, 1992

[51] Int. Cl.[5] ..... B65D 6/00

[52] U.S. Cl. ..... 220/4.25; 220/4.24; 220/342; 206/581; 206/806; 206/823

[58] Field of Search ..... 206/470, 581, 806, 823; 220/4.21, 4.22, 4.24, 4.25, 338, 342, 343, 523, 524, 525, 526

[56] References Cited

U.S. PATENT DOCUMENTS

| | | | |
|---|---|---|---|
| 2,012,800 | 8/1935 | Allen | 220/343 |
| 2,292,476 | 8/1942 | Rathbun | 220/342 |
| 3,043,354 | 7/1962 | Fitzgerald | 220/4.23 |
| 3,342,190 | 9/1967 | Hultgren et al. | 220/338 |
| 3,351,270 | 11/1967 | Hohnjec | 220/4.23 |
| 3,713,412 | 1/1973 | Ianuzzi | 220/4.25 |
| 4,043,477 | 8/1977 | Decse | 206/445 |
| 4,171,743 | 10/1979 | Mascia et al. | 220/4.25 |
| 4,349,102 | 9/1982 | Strongwater | 206/461 |
| 4,349,120 | 9/1982 | DiNardo | 220/338 |
| 4,454,889 | 6/1984 | Contreras, Sr. | 206/581 |
| 4,746,008 | 5/1988 | Heverly et al. | 220/338 |
| 4,899,882 | 2/1990 | Benner | 206/470 |
| 4,993,585 | 2/1991 | McMahon | 220/4.22 |
| 5,076,460 | 12/1991 | Hussell | 220/338 |
| 5,092,354 | 3/1992 | Pacelli, Jr. | 206/581 |

FOREIGN PATENT DOCUMENTS

| | | | |
|---|---|---|---|
| 2321800 | 11/1973 | Fed. Rep. of Germany | 220/4.25 |
| 1074246 | 3/1954 | France | 220/4.25 |

*Primary Examiner*—David T. Fidei
*Attorney, Agent, or Firm*—Thomas L. Adams

[57] ABSTRACT

A cosmetic organizer has a lower tray and an upper cover. The upper cover has an upper rim hinged to the lower tray. The upper rim has an erect annular wall. A relatively flexible upper shell overlays and is mounted flush on the erect annular wall. Thus, the shell has a soft feel but maintains an erect shape.

14 Claims, 2 Drawing Sheets

COSMETIC ORGANIZER

BACKGROUND OF THE INVENTION

The present invention relates to cosmetic organizers and, in particular, to an organizer having a hinged cover.

A cosmetic organizer is helpful for keeping numerous small cosmetic items together and readily available. A complement of cosmetics can include numerous small items such as eyeliner pencils, lipsticks, compacts, various bottles, brushes, etc. Much time can be lost locating these various items when applying make-up.

It is desirable to keep such cosmetics in a closed case so they are not lost when transported or stored. It is also desirable to have a hinged cover and a catch to keep the cover closed. Preferably, the organizer is compartmentalized but not unnecessarily complex.

Furthermore the organizer should preferably be easily manufactured from simply molds. Known molds can make relatively complex shapes by using only two halves, or "plates." In some case a three part mold or a cam operated insert may be necessary if the shape is too complex for a two-plate mold. Still a shape such as a torus can be made with a "pass through," that is, an element that passes through the hole of the torus.

For aesthetic and practical reasons, a cosmetic case is preferably soft. A completely soft case, however, is disadvantageous because the case will collapse into a distorted shape making the case difficult to use.

Accordingly there is a need for an organizer that is compact, soft but not collapsible, which can be manufactured efficiently.

SUMMARY OF THE INVENTION

In accordance with the illustrative embodiments demonstrating features and advantages of the present invention, there is provided a cosmetic organizer having a lower tray and an upper cover. The upper cover has an upper rim hinged to the lower tray. The upper rim has an erect annular wall. A relatively flexible shell overlays and is mounted flush on the erect annular wall. Thus, the shell has a soft feel but maintains an erect shape.

By employing such a structure, a relatively attractive and efficiently manufactured organizer is achieved. In a preferred embodiment, the organizer has a pair of mating oval rims. Each of the rims has a curved and converging annular wall. These walls are relatively rigid, but have a relatively soft and flexible plastic shell glued to these walls. Thus the sides of the organizer can be relatively rigid, while the top is soft. This arrangement gives the general feel of softness without the problems associated with the collapsing.

In the preferred embodiment, the organizer has a partition mounted on the inside of the cover to form a pocket. The partition is a flexible net that is secured by its mounting holes to hooks mounted in the side wall of the rim.

The preferred organizer has a longitudinally ribbed top and bottom surface. The rims are also arranged to allow a sheet to be closed inside of the organizer, but still allowing a hang tab to emerge between the rims. This feature enables the product to be hung from a display peg.

Other design features in the catch, the cover hinge and the hooks allow the organizer to be fabricated by a simple two plate mold using "pass throughs."

BRIEF DESCRIPTION OF THE DRAWINGS

The above brief description as well as other objects, features and advantages of the present invention will be more fully appreciated by reference to the following detailed description of presently preferred, but nonetheless illustrative embodiments, in accordance with the present invention, when taken in conjunction with the accompanying drawings, wherein.

DETAILED DESCRIPTION OF THE PREFERRED EMBODIMENTS

Figure 1:
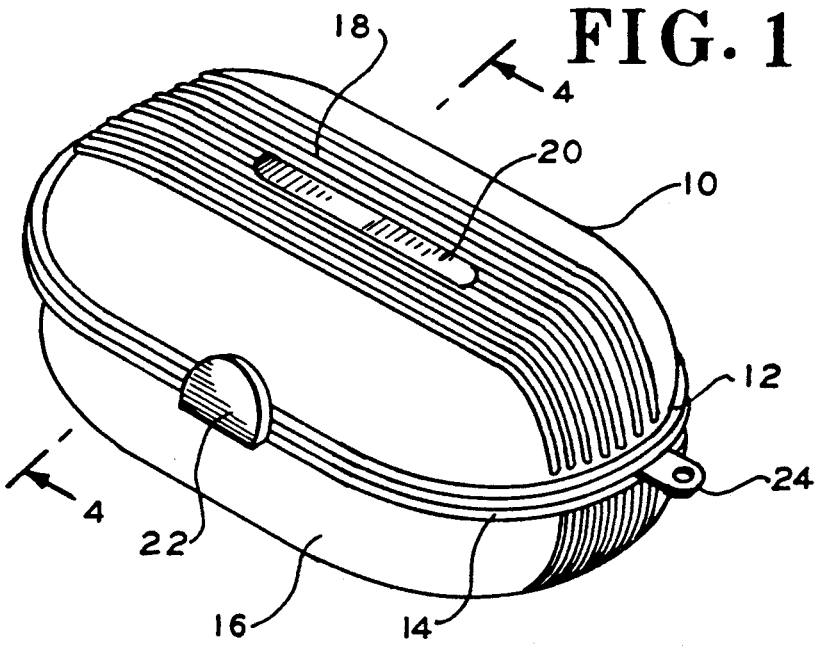
FIG. 1 is a perspective view of a cosmetic organizer in accordance with the principles of the present invention.

Referring to FIG. 1, a cosmetic organizer is shown with an upper cover having a relatively flexible upper shell 10. Shell 10 is mounted in an upper rim 12. Upper rim 12 mates with lower rim 14 into which a relatively flexible lower shell 16 is mounted. Shell 16 and rim 14 together comprise a lower tray.

Cover 10 has a plurality of longitudinal stiffening ribs 18 for stiffening the shell. An embossment 20 is located in the middle of the ribs 18 for displaying a trademark, logo or other designation.

Rims 12 and 14 are held together by latch button 22, described in further detail hereinafter. Also, a shipping sheet, which may be made of a transparent acetate, is held inside the cosmetic organizer but has an apertured tab 24 shown emerging between rims 12 and 14.

In one embodiment the organizer was 7½ inches long, 5 inches wide, and 2 inches tall, although other sizes are contemplated, depending upon the desired capacity and the nature of the articles being held in the organizer.

Referring to FIGS. 2, 3, 4 and 5, rims 12 and 14 are shown as a channel having an erect annular wall 26 and a dependent annular wall 28, respectively. Walls 26 and 28 are curved and converging to provide a dome-like aspect to the organizer. Shell 10 and shell 16 each have annular flanges 11 and 17, respectively. Flanges 11 and 17 fit into the channels of rims 12 and 14, respectively.

Lower rim 14 has a guide wall 30 with a breach 32. Breach 32 is designed to allow the protrusion of the previously mentioned apertured tab (tab 24 of FIG. 1), which is part of sheet 25. Sheet 25 may be imprinted with various designs and can display the names or images of articles that can be stored inside the organizer.

Figure 3:
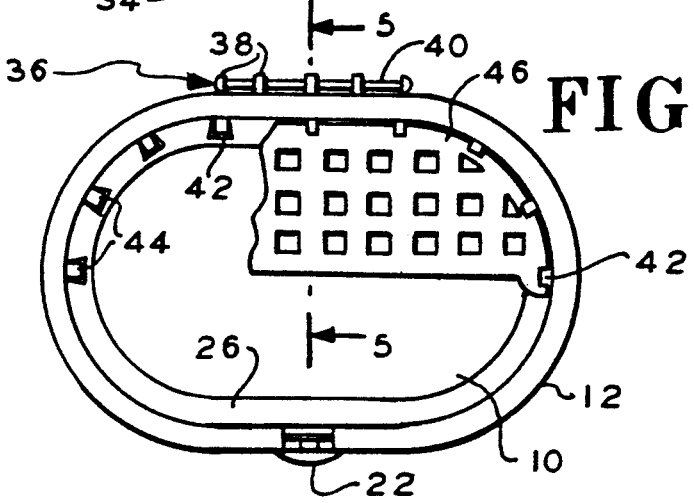
FIG. 3 is an inside view of the cover of the organizer of FIG. 1.
Figure 4:
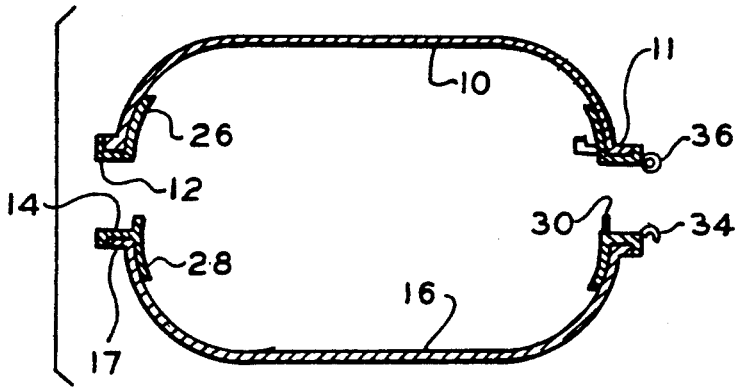
FIG. 4 is a cross sectional view taken along line 4—4 of FIG. 1.
Figure 5:
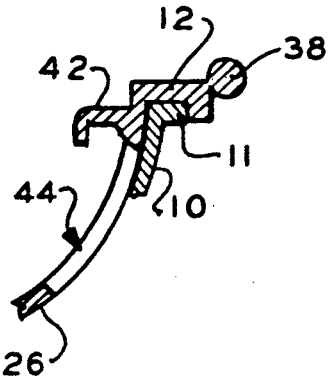
FIG. 5 is a cross sectional view of a hook taken along line 5—5 of FIG. 3.

Referring to FIGS. 3 and 5, nine hooks 42 are shown molded into annular wall 26. Hooks 42, when viewed in the plane of FIG. 3, are shown cantilevered over apertures 44. Hooks 42 are not large enough to screen apertures 44. Thus hooks 42 can be molded with a two plate design using "pass throughs." Such a design avoids the need for additional mold elements or cam actions that would complicate the manufacturing process.

Hooks 42 are shown hooked into mounting holes in partition 46. Partition 46 has a grid of holes to form a net-like structure. Partition 46, as well as shells 10 and 16, are about ⅛ inch thick and can be made of a soft PVC plastic (or another material such as rubber or thermoplastic rubber). The rims 12 and 14 can be made from a relatively rigid PVC plastic (or other materials such as ABS, polycarbonate, a high impact styrene or polypropylene). In other embodiments various different materials can be used including metals, ceramics, wood, leathers, etc.

Figure 2:
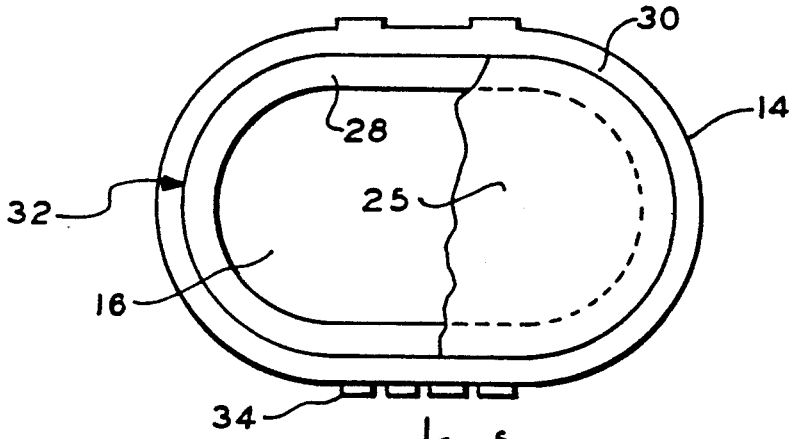
FIG. 2 is a plan view of the bottom tray of the organizer of FIG. 1.
Figure 6:
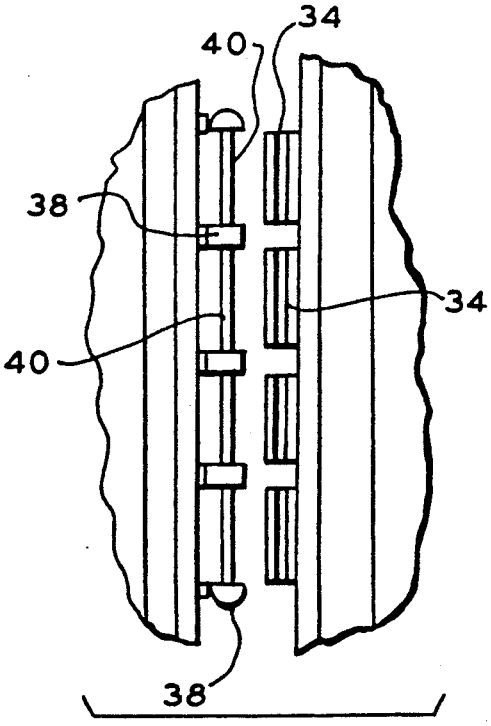
FIG. 6 is a detailed plan view of the hinge assembly of FIGS. 2 and 3 taken from the reverse side.

Referring to FIGS. 2, 3 and 6, a hinge assembly is shown including four C-shaped sleeves 34. A pivoting structure 36 is shown with a plurality of spacers 38 and coaxial shafts 40. The three central spacers 38 interdigitate with the four C-shaped sleeves 34. The coaxial shafts 40 are sized to snap into the C-shaped sleeves 34. An advantage with the multiple spacers is the increased support provided along a relatively long shaft. While four sleeves are illustrated, in other embodiments a different number may be used.

Figure 7:
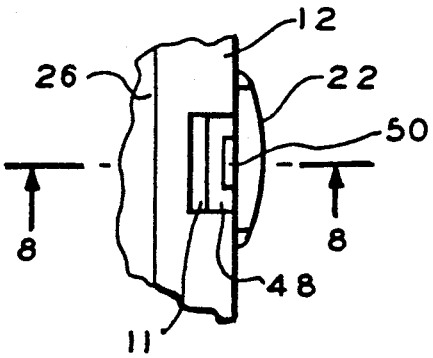
FIG. 7 is a detailed view of the catch of FIG. 3.
Figure 8:
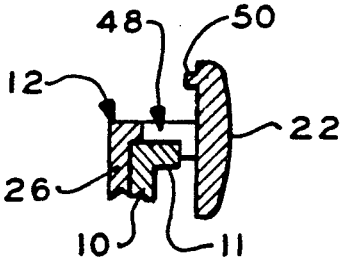
FIG. 8 is a cross sectional view of the catch of FIG. 7 taken along line 8—8 of FIG. 7.

Referring to FIGS. 7 and 8, previously illustrated latch button 22 is shown molded to span across a notch 48 in rim 12. Notch 48 allows the inward longitudinal ridge 50 on button 22 to be molded by a two plate process using "pass throughs." Ridge 50 is designed to snap around the underside of the opposing lower rim 14.

To facilitate an understanding associated with the principles of the foregoing invention, the use of the foregoing organizer will be briefly described. After molding, the flanges 11 and 17 of shells 10 and 16 can be placed the channels of rims 12 and 14. Preferably, the shells are glued in place, although other fastening techniques are possible such as solvent bonding or ultrasonic welding. Thereafter, the hinge may be snapped together by forcing shafts 40 into the C-shaped sleeves 34 (FIG. 6). Next, the partition 46 (FIG. 3) can be installed by pushing its mounting holes over hooks 42.

The user can now store various cosmetic items such as lipsticks, compacts, etc. Some of these items may be held in the pocket formed between partition 46 and shell 10. Once the articles are stored, the rims 12 and 14 can be closed and held together by latch 22.

Because shells 10 and 16 are relatively soft, the organizer has an aesthetically pleasing texture. However, the shells do not collapse because reinforcing walls 26 and 28 prevent the collapse or inversion of the soft shells.

It is to be appreciated that various modifications may be implemented with respect to the above described preferred embodiments. In some embodiments, the shape of the organizer can be more rectangular. Alternatively, the shape can be polygonal, spherical, or other desirable shapes. Also, the hinges can be of various types and in some cases a flexible band or joint will be formed between the rims. In addition, the latching can be performed by a swinging strap, a locking socket or other mechanisms. Furthermore, various materials can be used and in some cases metals, leathers, ceramics, and other materials may be substituted for those previously described.

Many modifications and variations of the present invention are possible in light of the above teachings. It is therefore to be understood that within the scope of the appended claims, the invention may be practiced otherwise than as specifically described.

I claim:

1. A cosmetic organizer comprising:

a lower tray; and an upper cover including:

(a) an upper rim hinged to said lower tray and having an erect annular wall, said erect wall having a domed shaped, and (b) a relatively flexible upper shell overlaying and mounted flush on said erect annular wall to follow its domed shape, said erect wall having at its top an inwardly converging slope for supporting and directing said upper shell away from said erect wall at said inwardly converging slope, said erect wall being relatively rigid in comparison to said upper shell and being sized and sloped to keep the upper shell flexible on top and rigid on its side and to prevent collapsing or inverting of the upper shell, whereby said shell has a soft feel but maintains an erect shape.

2. A cosmetic organizer according to claim 1 wherein said lower tray comprises:

a lower rim hinged to said upper rim and having a dependent annular wall, said dependent wall having an inverted domed shape, and a relatively flexible lower shell overlaying and mounted flush on said dependent annular wall to follow its domed shape, said dependent wall having below an inwardly converging slope for supporting and directing said lower shell away from said dependent wall at said inwardly converging slope, said dependent wall being relatively rigid in comparison to said lower shell and being sized and sloped to keep the lower shell flexible underneath and rigid on its side and to prevent collapsing or inverting of the lower shell.

3. A cosmetic organizer according to claim 2 wherein said upper and lower rims extend beyond said upper and lower shells.

4. A cosmetic organizer according to claim 3 wherein said dependent annular wall and said erect annular wall are curved and converging.

5. A cosmetic organizer according to claim 4 wherein said upper and lower shells each have a plurality of longitudinal stiffening ribs.

6. A cosmetic organizer according to claim 4 further comprising:

a partition mounted across part of said upper rim to form a pocket with said upper shell.

7. A cosmetic organizer according to claim 6 wherein said partition is perforated, flexible and has about the same thickness as said upper shell.

8. A cosmetic organizer according to claim 7 wherein said partition has a plurality of mounting holes and wherein said upper rim has a circumferentially spaced plurality of apertures in said erect annular wall and wherein said upper rim includes:

a circumferentially spaced plurality of hooks for holding said partition by its mounting holes, said hooks each being separately cantilevered over a corresponding one of said apertures in said erect annular wall, said hook when viewed in the plane of said partition being insufficiently sized to screen said aperture, so that said hook can be molded by a two part pass-through.

9. A cosmetic organizer according to claim 4 wherein either said upper or said lower rim has a notch and comprises:

a latch button spanning said notch and having an inward ridge for engaging and holding closed said lower and upper rims.

10. A cosmetic organizer according to claim 4 wherein said upper and lower rims each comprise a channel, and said upper and lower shells each have a flange fitting into said channel.

11. A cosmetic organizer according to claim 4 comprising:

a plurality of axially spaced, C-shaped sleeves and a pivot structure including: (a) a plurality of spacers projecting from one of either said upper or said lower rim, the other one of said rims supporting said sleeves, said sleeves being sized to interdigitate with said spacers, and (b) a plurality of coaxial shafts spanning said spacers and pivotally mounted inside said sleeves.

12. A cosmetic organizer according to claim 4 comprising:

a guide wall mounted on either one of said lower or said upper rim and sized to fit inside the other one of said upper and said lower rims.

13. A cosmetic organizer according to claim 12 wherein said guide wall has a breach, said organizer comprising:

a sheet sized to fit within said guide wall and having an apertured tab sized to fit through said breach, so that said organizer can be hung from said tab.

14. A cosmetic organizer comprising:

a lower rim having an annular lower channel and a dependent annular wall, said dependent annular wall being curved and converging;

a relatively flexible lower shell overlaying and mounted flush on said dependent annular wall and having a lower flange fitting into said lower channel;

an upper rim hinged to said lower rim and having a notch, an annular upper channel, and an erect annular wall, said erect annular wall being curved and converging and having a circumferentially spaced plurality of apertures;

a relatively flexible upper shell overlaying and mounted flush on said erect annular wall and having an upper flange fitting into said upper channel, so that said upper shell has a soft feel but maintains an erect shape, said upper and lower shells each having a plurality of longitudinal stiffening ribs, said upper and said lower rims extending beyond said upper and lower shells;

a perforated, flexible partition mounted across part of said upper rim to form a pocket region with said upper shell, said partition having about the same thickness as said upper shell and having a circumferentially spaced plurality of mounting holes;

a circumferentially spaced plurality of hooks for holding said partition by its mounting holes, said hooks each being separately cantilevered over a corresponding one of said apertures in said erect annular wall, said hook when viewed in the plane of said partition being insufficiently sized to screen said aperture, so that said hook can be molded by a two part pass-through;

a latch button spanning said notch in said upper rim and having an inward ridge for engaging and holding closed said lower rim;

a plurality of axially spaced, C-shaped sleeves projecting from said lower rim;

a pivot structure including: (a) a plurality of spacers projecting from said upper rim, said spacers being sized to interdigitate with said sleeves, and (b) a plurality of coaxial shafts spanning said spacers and pivotally mounted inside said sleeves;

a guide wall mounted on said lower rim and sized to fit inside said upper rim, said guide wall having a breach; and a sheet sized to fit within said guide wall and having an apertured tab sized to fit through said breach, so that said organizer can be hung from said tab.

* * * * *